US008784161B1

(12) United States Patent
Burleson et al.

(10) Patent No.: US 8,784,161 B1
(45) Date of Patent: Jul. 22, 2014

(54) MANDREL ASSEMBLY FOR REPAIRING DRILL PIPE FACINGS

(71) Applicant: Tubular Inspection Products, Inc., Odessa, TX (US)

(72) Inventors: Jimmy F. Burleson, Odessa, TX (US); Gary Chambers, Odessa, TX (US)

(73) Assignee: Tubular Inspection Products, Inc., Odessa, TX (US)

( * ) Notice: Subject to any disclaimer, the term of this patent is extended or adjusted under 35 U.S.C. 154(b) by 0 days.

(21) Appl. No.: 14/142,194

(22) Filed: Dec. 27, 2013

(51) Int. Cl.
*B24B 5/04* (2006.01)
*B24D 9/04* (2006.01)
*B24B 5/06* (2006.01)

(52) U.S. Cl.
CPC ... *B24D 9/04* (2013.01); *B24B 5/06* (2013.01); *B24B 5/04* (2013.01)
USPC ..... 451/278; 451/344

(58) Field of Classification Search
CPC ..... B24B 5/04; B24B 5/06
USPC ..... 451/344, 348, 49, 51, 278
See application file for complete search history.

(56) References Cited

U.S. PATENT DOCUMENTS

| | | | | | |
|---|---|---|---|---|---|
| 2,159,287 | A * | 5/1939 | Morgan | 451/441 |
| 2,211,183 | A * | 8/1940 | Tytus et al. | 408/81 |
| 3,608,406 | A * | 9/1971 | Paysinger et al. | 82/1.11 |
| 3,691,882 | A * | 9/1972 | Massey | 82/113 |
| 3,717,055 | A * | 2/1973 | Pendleton | 82/113 |
| 4,665,780 | A * | 5/1987 | Plaquin et al. | 82/1.11 |
| 4,761,104 | A * | 8/1988 | Hillestad | 409/175 |
| 4,854,200 | A * | 8/1989 | Mynhier | 82/110 |
| 4,954,023 | A * | 9/1990 | Bromley | 408/1 R |
| 5,062,187 | A * | 11/1991 | Bromley | 451/51 |
| 5,433,130 | A * | 7/1995 | Smith et al. | 82/113 |
| 7,784,551 | B2 * | 8/2010 | Angman et al. | 166/382 |
| 2012/0132044 | A1 * | 5/2012 | Manwaring | 82/1.11 |

* cited by examiner

*Primary Examiner* — Maurina Rachuba
(74) *Attorney, Agent, or Firm* — Buskop Law Group, PC; Wendy Buskop

(57) ABSTRACT

The mandrel assemblies include a double face box mandrel assembly with box refacing tube, male mandrel adapter for engaging within a bore of the box refacing tube, a box mandrel assembly floating over the male mandrel adapter and connected to a drill pipe connection. A box facing mandrel adapter connects to the male mandrel adapter, an outer face plate mounts over the box mandrel assembly engaging the box refacing tube; an inner face plate mounts over the box facing mandrel adapter shaft and attaches to a flange. A double face pin mandrel assembly with pin refacing tube, male mandrel adapter, and pin facing mandrel adapter engages a male mandrel adapter, a pin mandrel assembly floats over the male mandrel adapter and pin facing mandrel adapter and connects to a drill pipe connection opposite the double face box mandrel assembly.

4 Claims, 11 Drawing Sheets

MANDREL ASSEMBLY FOR REPAIRING DRILL PIPE FACINGS

FIELD

The present embodiments generally relate to mandrel assemblies for use in repairing facings of double shoulder drill pipe connections, and in particular to a double face box mandrel assembly for one end of a drill pipe connection and a double face pin mandrel assembly for an opposite end of the same drill pipe connection.

BACKGROUND

A need exists for a simple device that an average oil field worker can use to repair facings of double shoulder drill pipe.

A need exists for a simple device that can reface double shoulder drill pipe connections without having to truck the drill pipe to another location.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the apparatus in detail, it is to be understood that the apparatus is not limited to the particular embodiments and that it can be practiced or carried out in various ways.

The invention assists in reducing road accidents. By refacing the drill pipe connections in the field using the mandrel assemblies, drill pipe no longer needs to be trucked on icy roads back to where machine shops are located.

The mandrel assemblies enable a reduction in the use of fossil fuels and reduce pollution of the atmosphere by trucks. The mandrel assemblies enable drill pipe connection refacing in the field that is both quick and easy, in that an average oil field worker can use it.

The embodiments reduce the possibility of injuries to oil field workers in that they allow repair of drill pipe connections at the site without needing to use a fork lift.

The embodiments have the advantage of not needing electricity to resurface the drill pipe connection other than to operate a simple grinder and turn the tool with the grinder.

The embodiments reduce energy costs because the electricity needed to run a hand grinder is minimal.

The embodiments enable drill pipe refinishing in the field in less than 1 hour for up to 15 to 20 drill pipe refacings. The refacing can be achieved in less than 5 minutes per drill pipe in embodiments.

A grinder can simply rotate the entire mandrel assembly to achieve drill pipe refacing. The entire assembly, in embodiments, can move in a 360 degree circle at 3500 revolutions per minute.

The mandrel assemblies can include a double face box mandrel assembly and a double pin face mandrel assembly.

Figure 1B:
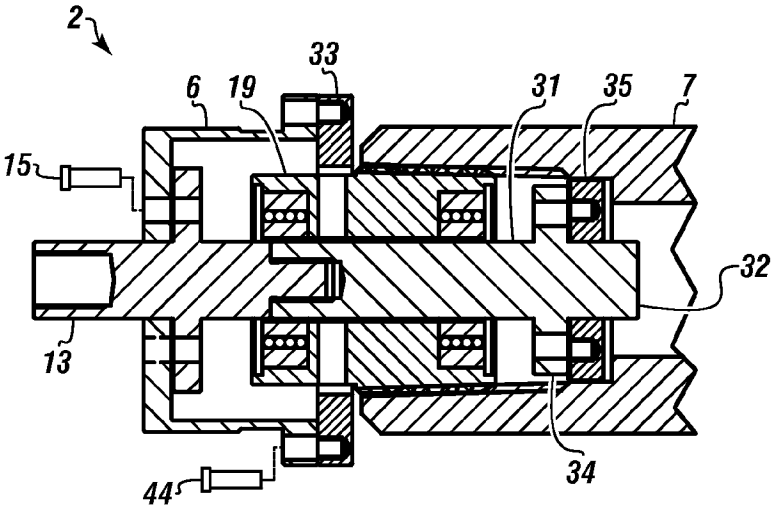
FIG. 1B is a cross sectional view of the assembled double face box mandrel assembly.
Figure 1A:
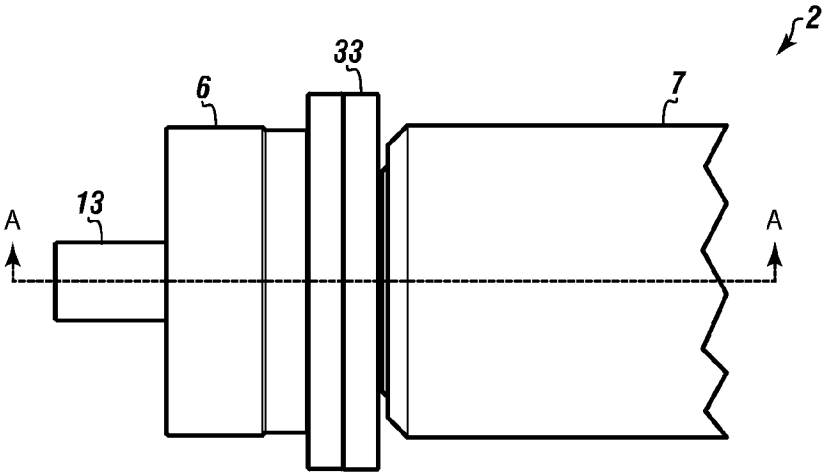
FIG. 1A is a side view of an assembled double face box mandrel assembly.

Turning now to the Figures, FIG. 1A shows an assembled side view of a double face box mandrel assembly 2 as fitted on a box connection end of a drill pipe connection 7.

A box refacing tube 6 is shown. An outer face plate 33 can connect to the box refacing tube 6 with a male mandrel adapter 13 opposite the drill pipe connection 7.

FIG. 1B is a cross sectional view of the assembled double face box mandrel assembly 2 along cut line A-A shown in FIG. 1A.

The double face box mandrel assembly 2 can have a box refacing tube 6 and a male mandrel adapter 13 for engaging with the box refacing tube 6. The double face box mandrel assembly can include a box mandrel assembly 19 floating over the male mandrel adapter 13 and connected to a drill pipe connection 7.

A box facing mandrel adapter 31 can be connected to the male mandrel adapter 13.

An outer face plate 33 can attach to the box refacing tube 6.

An inner face plate 35 can be mounted over the box facing mandrel adapter shaft 32 and secured to a face plate flange 34 of the box facing mandrel adapter 31.

One or more fasteners 44 can secure both face plates to the box refacing tube 6 and to the pin facing mandrel adapter.

One or more fasteners 15 can be used for attaching the male mandrel adapter 13 to the box refacing tube 6.

Abrasive material, such as sandpaper, can be mounted to each outer face plate enabling refacing of the shoulders of the drill pipe connection.

Figure 2B:
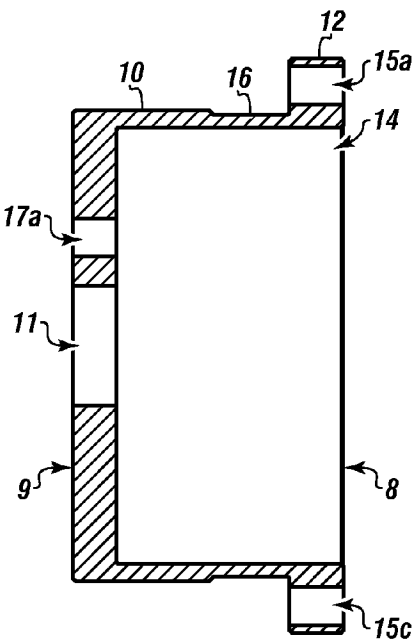
FIG. 2B is a cross sectional view of the box refacing tube.
Figure 2A:
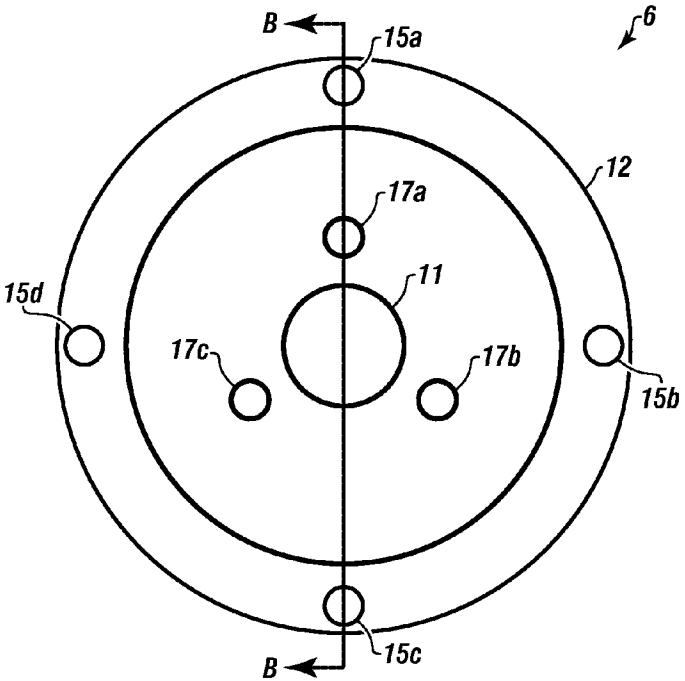
FIG. 2A is a top view of a box refacing tube.

FIG. 2A shows a top view of the box refacing tube 6 with a shaft bore 11 with a plurality of male mandrel fastening holes 17*a*-17*c*.

A flange 12 can extend from the box refacing tube 6.

Fastening holes 15*a*-15*d* are shown for connecting the box refacing tube to the outer face plate.

FIG. 2B shows a cross sectional view of the box refacing tube 6 along cut line B-B of FIG. 2A.

The box refacing tube 6 is depicted with a first end 8 and a second end 9.

The box refacing tube 6 is shown with an outer side 10 and a shaft bore 11 formed in the second end 9.

The box refacing tube 6 is shown with a flange 12 formed and extending from the outer side 10 while spaced apart from the first end 8.

A counter bore 14 is shown formed extending from the second end 8. The counter bore 14 can have a diameter at least 100 percent larger than the shaft bore.

Fastening holes 15*a* and 15*c* are shown formed in the flange 12.

An undercut 16 can be formed on the outer side 10 adjacent the flange 12.

Male mandrel fastening hole 17*a* is shown penetrating the second end.

Figure 3B:
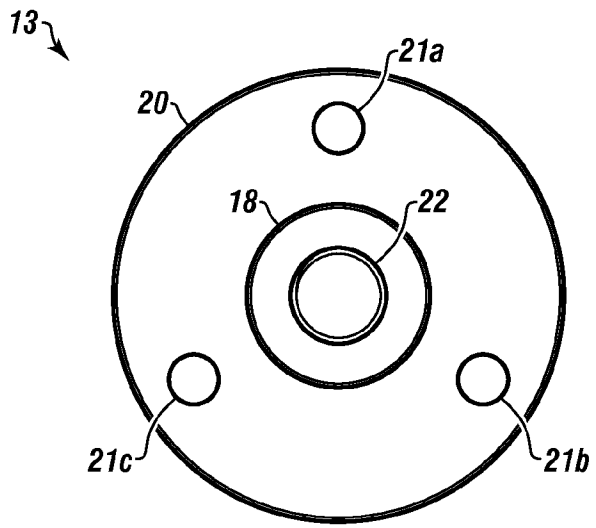
FIG. 3B is a top view of the male mandrel adapter.
Figure 3A:
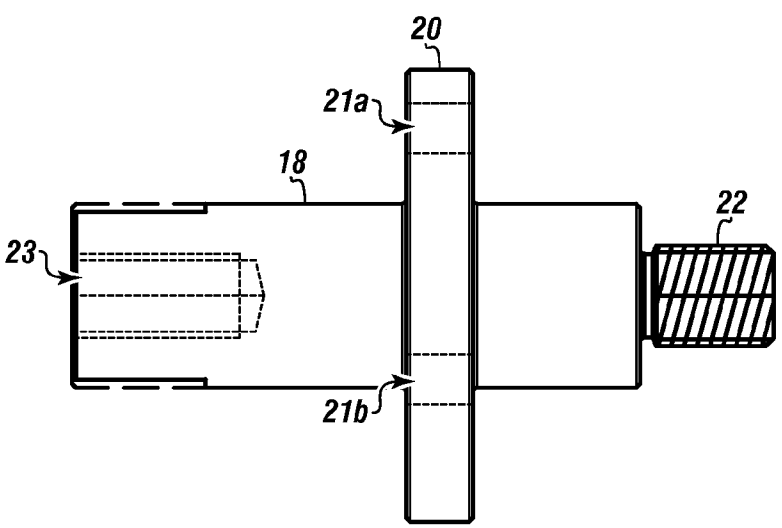
FIG. 3A is a side view of a male mandrel adapter.

FIGS. 3A and 3B show a detail of a male mandrel adapter 13

FIG. 3A is a side view of the male mandrel adapter 13 for engaging within the shaft bore of the box refacing tube.

The male mandrel adapter is shown with a mandrel flange 20 extending from a shaft 18.

A plurality of male mandrel adapter fastening holes 21*a* and 21*b* are shown formed in the mandrel flange 20.

A male mandrel adapter portion 22 is depicted mounted to the shaft 18 on an opposite side of the mandrel flange 20 and can have a diameter less than a diameter of the shaft 18.

In embodiments, the male mandrel adapter portion 22 can screw into threads in a box facing mandrel shaft.

The shaft 18 is depicted with a tapped hole 23 for securing to a grinder that rotates the assembly refacing a drill pipe connection.

FIG. 3B depicts a top view of the male mandrel adapter.

The male mandrel adapter 13 is depicted with a shaft 18, a mandrel flange 20 integral with and surrounding the shaft 18 and a male mandrel adapter portion 22 connected on the shaft.

A plurality of male mandrel adapter fastening holes 21*a*-21*c* is shown.

A plurality of fasteners, such as bolts, can be used to penetrate the male mandrel adapter fastening holes. Each fastener can penetrate the male mandrel adapter fastening hole for connecting the male mandrel adapter to the box refacing tube.

Figure 4B:
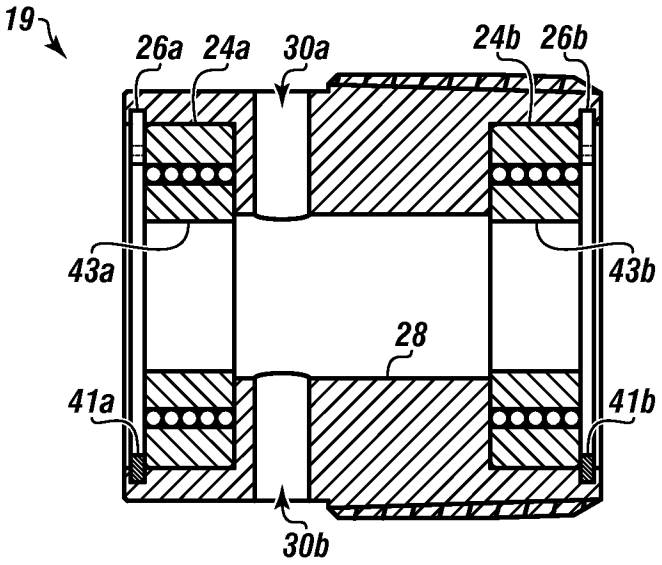
FIG. 4B is a cross sectional view of the box mandrel assembly.
Figure 4A:
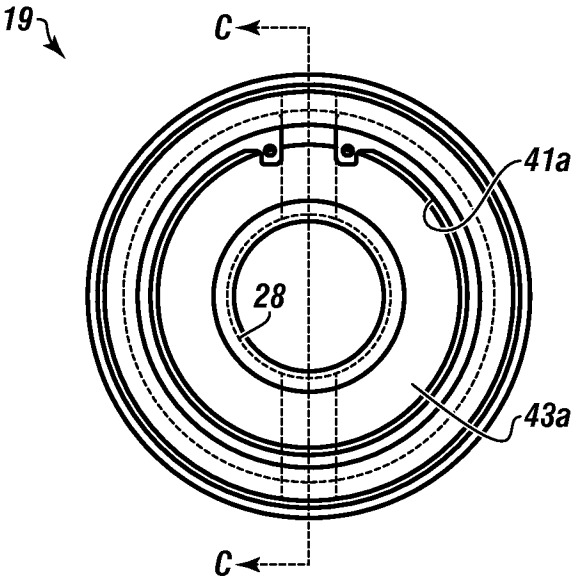
FIG. 4A is a top view of a box mandrel assembly.

FIGS. 4A and 4B show a box mandrel assembly.

FIG. 4A shows a top view of the box mandrel assembly 19 with cut line C-C across a conduit 28.

A first retainer ring 41*a* can snap into a second retainer ring groove that holds in a first ball bearing assembly 43*a*.

The box mandrel assembly 19 is for floating over the male mandrel adapter and the box facing mandrel adapter shaft.

FIG. 4B shows a cross sectional view of the box mandrel assembly 19 along cut line C-C shown in FIG. 4A.

The box mandrel assembly 19 can have a first bearing bore 24*a*.

The first bearing bore 24*a* can have a first retainer ring groove 26*a*.

The box mandrel can have a second bearing bore 24*b* and a second retainer ring groove 26*b*.

The box mandrel can have a conduit 28 formed between the first and second bearing bores with a plurality of tightening holes 30*a* and 30*b* to connect the box mandrel to drill pipe connection.

A first retainer ring 41*a* can snap into the first retainer ring groove 26*a* that holds in a first ball bearing assembly 43*a* in the first bearing bore 24*a*.

A second retainer ring 41*b* can snap into the second retainer ring groove 26*b* that holds in a second ball bearing assembly 43*b* in the second bearing bore 24*b*.

Figure 5B:
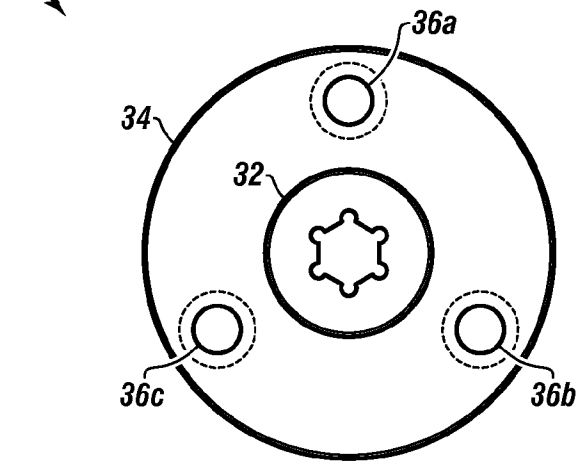
FIG. 5B is a top view of the box facing mandrel adapter.
Figure 5A:
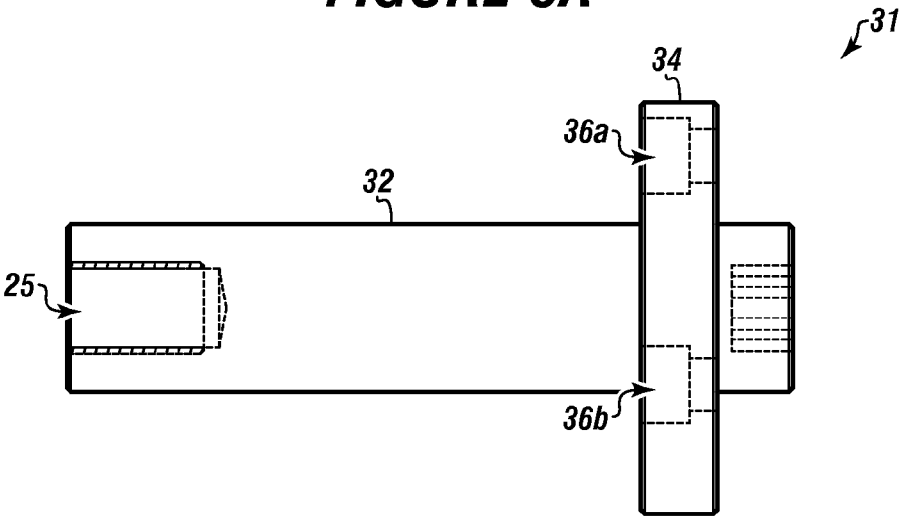
FIG. 5A is a side view of a box facing mandrel adapter.

FIGS. 5A and 5B show the box facing mandrel adapter. The box facing mandrel adapter can connect to the male mandrel adapter.

FIG. 5A shows a side view of the box facing mandrel adapter 31 which can have a box facing mandrel adapter shaft 32. The box facing mandrel adapter shaft 32 can have a mandrel shaft assembly hole 25 with threads for engaging the male mandrel adapter portion.

A face plate flange 34 is shown extending away from the box facing mandrel adapter shaft 32. Bolt holes 36*a* and 36*c* are shown penetrating the face plate flange.

FIG. 5B is a top view of the box facing mandrel adapter 31 with a face plate flange 34 with bolt holes 36*a*-36*c*. The face plate flange 34 is shown extending from the box facing mandrel adapter shaft 32.

Figure 6B:
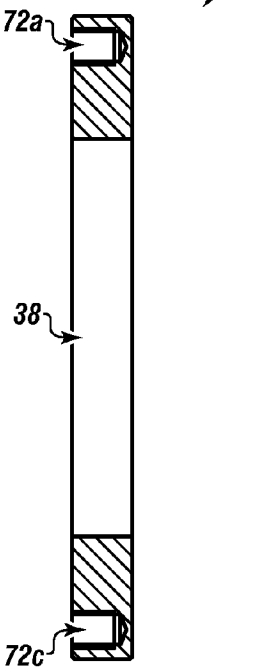
FIG. 6B is a cross sectional view of the outer face plate.
Figure 6A:
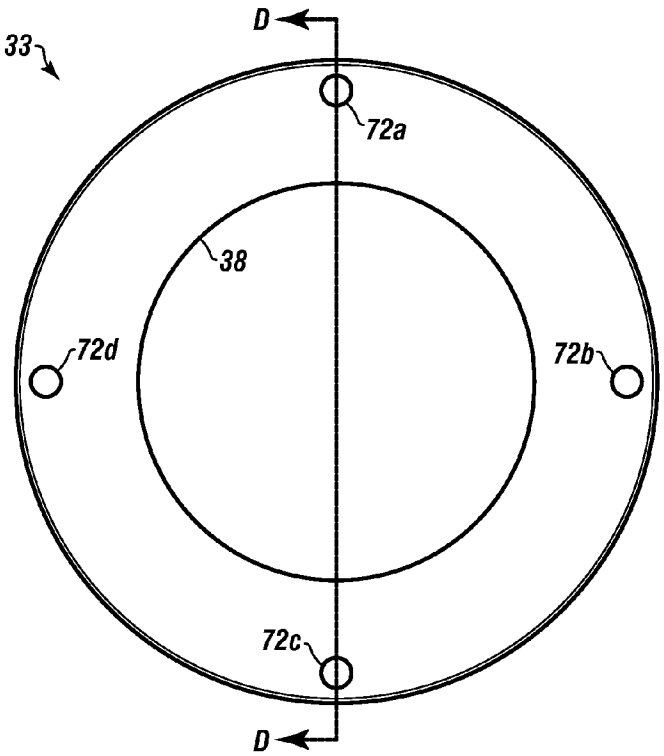
FIG. 6A is a top view of an outer face plate.

FIGS. 6A and 6B depict an outer face plate for mounting over the box facing mandrel adapter to a flange of a box refacing tube.

FIG. 6A is a top view of an outer face plate 33 with tightening holes 72*a*-72*d* and a face plate bore 38 with a cut line D-D.

FIG. 6B is a cross sectional view of the outer face plate 33 along the cut line D-D shown in FIG. 6A, with the tightening holes 72*a* and 72*c* and the face plate bore 38.

Figure 7B:
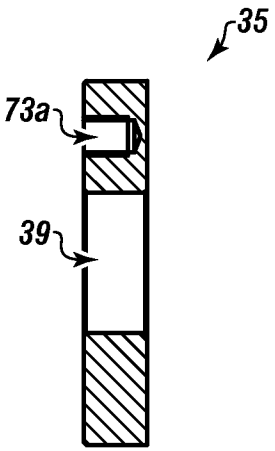
FIG. 7B is a cross sectional view of the inner face plate.
Figure 7A:
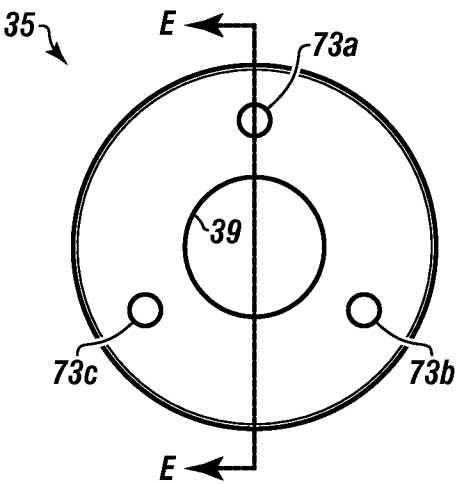
FIG. 7A is a top view of an inner face plate.

FIGS. 7A and 7B depict an inner face plate for mounting over the box facing mandrel adapter shaft and securing to the face plate flange.

FIG. 7A is a top view of an inner face plate 35 with a central hole 39 and fastening holes 73*a*-73*c* and a cut line E-E.

FIG. 7B is a cross sectional view of the inner face plate along cut line E-E with the central hole 39 and one of the fastening holes 73*a*.

Figure 8A:
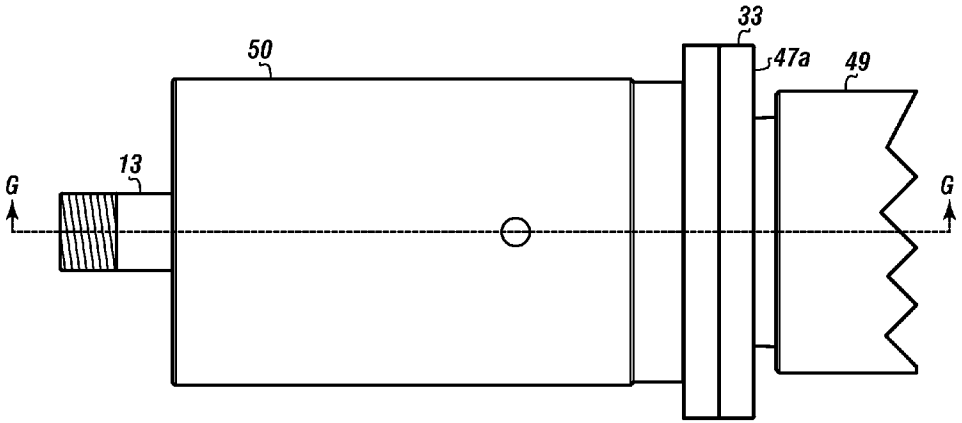
FIG. 8A is a side view of a double face pin mandrel assembly.

FIG. 8A is a side view of an assembled double face pin mandrel assembly 4 attached to a drill pipe connection 49.

A pin refacing tube 50 can be mounted around the male mandrel adapter 13.

An outer face plate 33 is shown connected to the pin refacing tube 50.

A first abrasive material 47*a*, such as sandpaper, can be connected to the outer face plate 33.

Figure 8B:
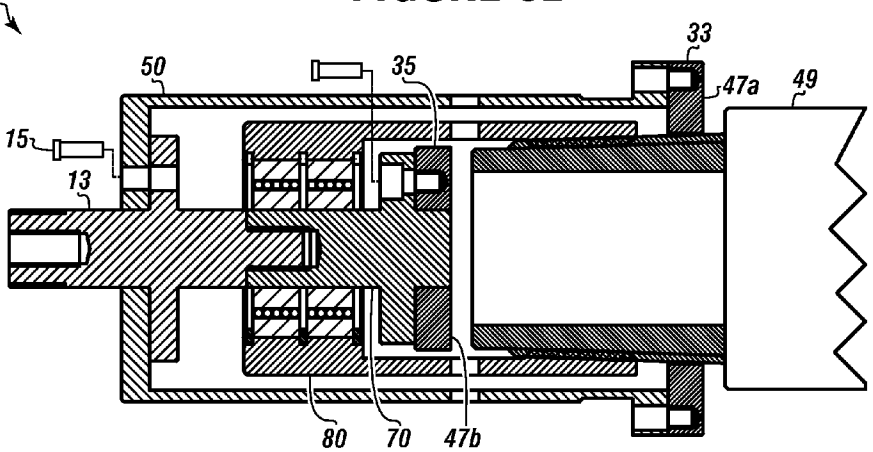
FIG. 8B is a cross sectional view of the double face pin mandrel assembly.

FIG. 8B is a cross sectional view of the assembled double face pin mandrel assembly 4 along cut line G-G wherein the assembled double face pin mandrel assembly 4 is shown attached to a drill pipe connection 49.

A male mandrel adapter 13 is shown.

A pin refacing tube 50 can be disposed around the male mandrel adapter and connected to the male mandrel adapter.

Pin facing mandrel adapter 70 can connect to the male mandrel adapter 13 through the pin mandrel assembly 80.

Inner face plate 35 can connect to the pin facing mandrel adapter 70.

The pin mandrel assembly 80 can ride over the male mandrel adapter portion 22.

A second abrasive material 47*b* can be attached to inner face plate 35.

The outer face plate 33 can connect to the pin refacing tube 50.

A first abrasive material 47*a* can be attached to outer face plate 33.

Figure 9B:
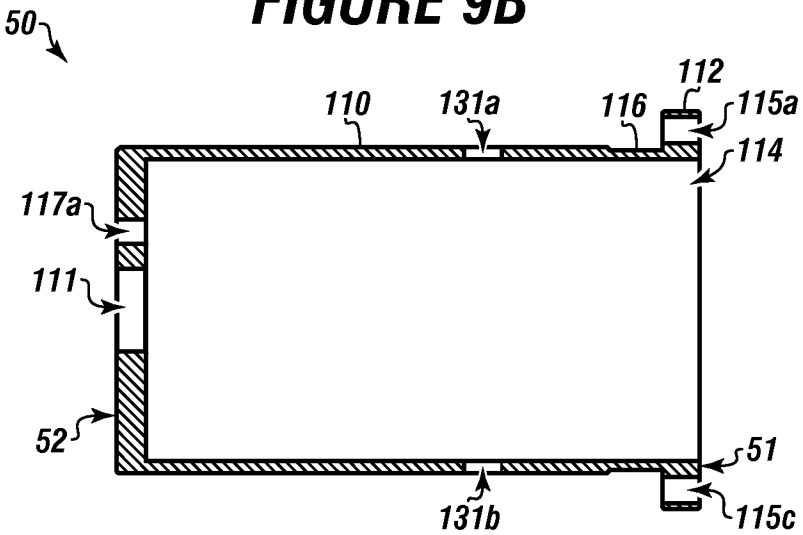
FIG. 9B is a cross sectional view of the pin refacing tube.
Figure 9A:
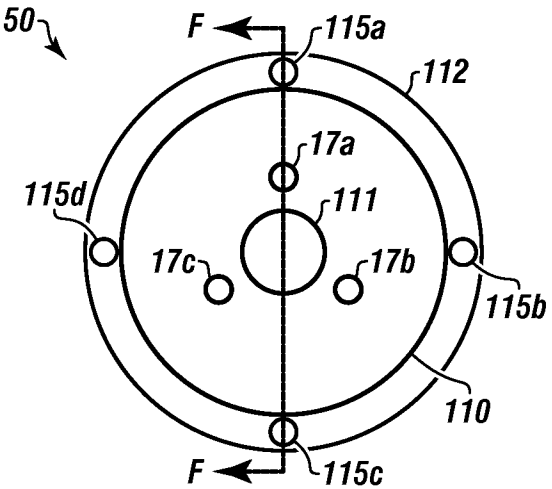
FIG. 9A is a top view of a pin refacing tube.

FIG. 9A shows a top view of a pin refacing tube 50 with a cut line F-F.

In the top view, a second end 52 is viewed with a plurality of male mandrel fastening holes 117*a*-117*c* penetrating the second end 52.

A flange 112 can extend from an outer side of the pin refacing tube.

A shaft bore 111 is shown.

Also shown are a plurality of fastening holes 115*a*-115*d* formed through the flange 112.

FIG. 9B is a cross section view of a pin refacing tube along the cutline F-F shown in FIG. 9A.

The pin refacing tube 50 can have an outer side 110 and a shaft bore 111 formed in the second end 52.

A counter bore 114 can be formed in the pin refacing tube and can have a diameter at least 100 percent larger than the shaft bore 111.

The pin refacing tube 50 can have a flange 112 extending from the outer side 110 adjacent the first end 51.

The flange 112 can have a plurality of fastening holes. Two of the fastening holes 115*a* and 115*c* are shown penetrating through the flange 112.

An undercut 116 can be in through the outer side 110 and proximate the flange 112. A plurality of tightening holes 131*a*-131*b* can be formed though the outer side 110. The undercut allows bolts to be tightened to a face plate, such as with a wrench.

Figure 10B:
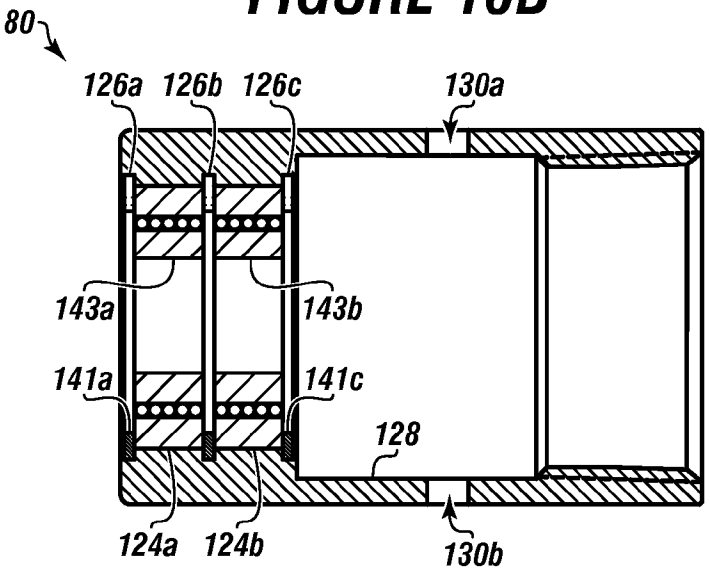
FIG. 10B is a cross sectional view of the pin mandrel assembly.
Figure 10A:
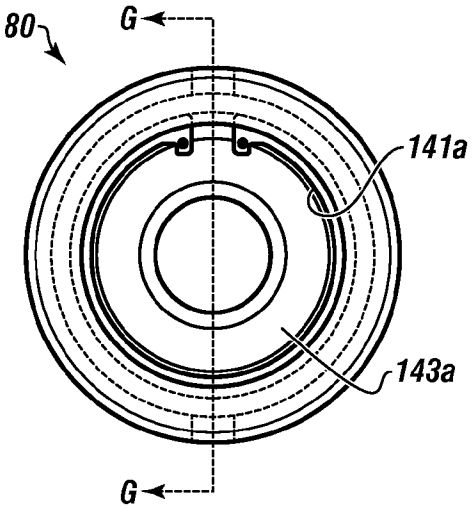
FIG. 10A is a top view of a pin mandrel assembly.

FIGS. 10A and 10B depict a pin mandrel assembly floating over the male mandrel adapter.

The double face pin mandrel assembly can use a male mandrel adapter having an identical size and structure to the male mandrel adapter of the double face box mandrel assembly.

The male mandrel adapter can have a shaft and a mandrel flange connected to the shaft.

FIG. 10A shows a top view of the pin mandrel assembly 80 with cut lines G-G and a plurality of tightening holes which are used to connect the pin mandrel assembly to a second drill pipe connection.

A first retainer ring 141*a* is shown for engaging a retainer ring groove to keep a ball bearing 143*a* in the bearing bores.

FIG. 10B shows a cross sectional view of the pin mandrel assembly 80 along the cut lines G-G shown in FIG. 10A.

The pin mandrel assembly 80 can have a first bearing bore 124*a*; a first retainer ring groove 126*a*; a second bearing bore 124*b*; a second retainer ring groove 126*b*; and a third retainer ring groove 126*c*.

The pin mandrel assembly 80 can have a conduit 128 formed adjacent the first and second bearing bores.

The pin mandrel assembly 80 can have a plurality of tightening holes 130*a*-130*b* penetrating an outer side of the pin mandrel assembly 80 connecting the pin mandrel assembly to a second drill pipe connection 49.

The pin mandrel assembly 80 can have a first ball bearing assembly 143*a* in the first bearing bore and a second ball bearing assembly 143*b* in the second bearing bore.

Retainer rings 141*a*, 141*b*, 141*c* can be used engaging each retainer ring groove to keep the ball bearings in the bearing bores.

Figure 11B:
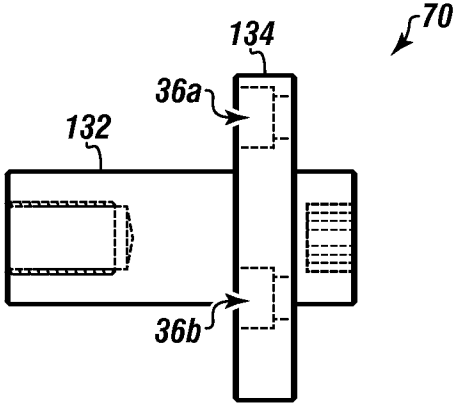
FIG. 11B is a side view of the pin facing mandrel adapter.
Figure 11A:
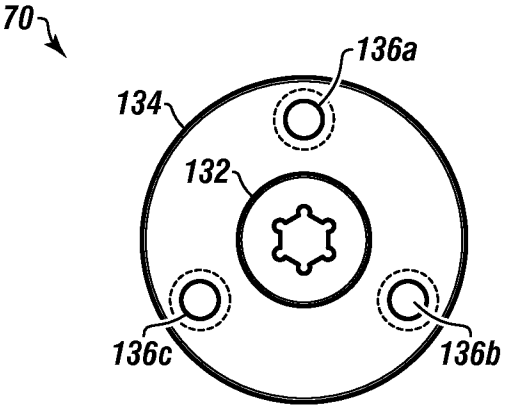
FIG. 11A is a top view of a pin facing mandrel adapter.

FIGS. 11A and 11B depict the pin facing mandrel adapter connected to the pin mandrel on a side opposite the male mandrel adapter.

FIG. 11A is a top view of a pin facing mandrel adapter.

FIG. 11B is a side view of the pin facing mandrel adapter.

Referring to FIGS. 11A and 11B, the pin facing mandrel adapter 70 can have a pin facing mandrel adapter shaft 132 for engaging with a mandrel shaft adapter through the pin mandrel assembly.

A pin face plate flange 134 can have bolt holes 136*a*-136*c*. The pin face plate flange can extend from the pin facing mandrel adapter shaft 132.

Fasteners can connect the male mandrel to the box refacing tube through the fastening holes.

This mandrel assembly can have both an outer face plate mounted over the box facing mandrel to an outer side of a box refacing tube and an inner face plate for mounting over the box facing mandrel adapter shaft and securing to the face plate flange.

To form the double face box mandrel assembly, the following steps are used:

A first bearing is pressed into the first bearing bore in the box mandrel assembly.

A first retainer ring is inserted into the first retainer groove.

A second bearing is pressed into the second bearing bore on the box mandrel assembly.

A second retainer ring is inserted into a second retainer groove.

The box mandrel assembly is slid over a male mandrel adapter portion of a male mandrel adapter with a first bearing bore facing the mandrel flange.

A box facing mandrel adapter is screwed onto the male mandrel adapter using threads machined into the two parts.

The mandrel adapter assembly with box mandrel assembly is slid into the box refacing tube.

A mandrel flange is attached using fasteners inserted through male mandrel adapter fastening holes in the mandrel flange and inserted through the male mandrel fastening holes in the box refacing tube using fasteners, such as socket head cap screws of the right size.

An outer face plate is attached to the flange on the box refacing tube using fasteners, such as socket head cap screws of the right size.

The inner face plate is attached to the face plate flange with fasteners through holes on the box facing mandrel adapter with fasteners, such as socket head cap screws of the right size.

An abrasive material, such as self-adhesive sand paper, is cut to match the size of the outer face plate and attached to the outer face plate with the adhesive side.

An abrasive material, such as self-adhesive sand paper is cut to match the size of the inner face plate and attached to the inner face plate with the adhesive side forming the double face box mandrel assembly.

A shaft of a double face box mandrel assembly is screwed onto a right angle grinder using a tapped hole on a male mandrel adapter.

The double face box mandrel assembly is screwed onto the box end of drill pipe using tightening holes on the box mandrel assembly until the drill pipe connection is tight.

The right angle grinder is then turned on, and pressure is applied using the abrasive material to the shoulders of the drill pipe connection until a desired finish is achieved.

To form the double face pin mandrel assembly, the following steps are used:

A third retainer ring is inserted into a third retainer groove on the pin mandrel.

A ball bearing is pressed into a second bearing bore on the pin mandrel then a second retainer ring is inserted into a second retainer groove.

A first retainer ring is pressed into the first retainer ring groove.

The pin mandrel assembly is slid over a male mandrel adapter portion with the bearing facing mandrel flange.

A pin facing mandrel adapter is screwed onto the male mandrel adapter portion using threads machined into the two parts.

The mandrel adapter assembly with pin mandrel assembly is slid into the pin refacing tube and the mandrel flange is attached using the fastening holes with fasteners, such as socket head cap screws of the right size.

An outer face plate is attached to flange on the pin refacing tube using fasteners, such as socket head cap screws of the right size.

The inner face plate is attached to the face plate flange on pin facing mandrel adapter with fasteners, such as socket head cap screws of the right size.

A first abrasive material, such as self-adhesive sand paper, is cut to match the size of the outer face plate and attached to the outer face plate with the adhesive side.

A second abrasive material, such as self-adhesive sand paper, is cut to match the size of the inner face plate and attached to the inner face plate with the adhesive side forming the double face pin mandrel assembly.

The double face pin mandrel assembly is screwed onto a right angle grinder at a tapped hole on the shaft at the end of a male mandrel adapter.

The double face pin mandrel assembly is screwed onto the pin end of drill pipe using tightening holes on the pin mandrel until the drill pipe connection is tight.

The right angle grinder is then turned on, and pressure is applied using the abrasive to the shoulders of the drill pipe connection until a desired finish is achieved.

While these embodiments have been described with emphasis on the embodiments, it should be understood that within the scope of the appended claims, the embodiments might be practiced other than as specifically described herein.

What is claimed is:

1. A double face box mandrel assembly for use on a drill pipe connection, the assembly comprising:

a. a box refacing tube comprising:
- (i) a first end and a second end;
- (ii) an outer side;
- (iii) a shaft bore;
- (iv) a counter bore wherein the counter bore has a diameter at least 100 percent larger than the shaft bore;
- (v) a flange extending from the outer side and spaced apart from the first end and the second end;
- (vi) a plurality of fastening holes in the flange;
- (vii) a plurality of male mandrel fastening holes penetrating the second end; and
- (viii) an undercut formed on the outer side and adjacent the flange;

b. a male mandrel adapter for engaging within the shaft bore of the box refacing tube, the male mandrel adapter comprising:
- (i) a shaft with a tapped hole for securing to a grinder;
- (ii) a mandrel flange connected to the shaft;
- (iii) a mandrel shaft adapter attached to the shaft; and
- (iv) a plurality of male mandrel adapter fastening holes;

c. a fastener for connecting the male mandrel adapter to the box refacing tube;

d. a box mandrel assembly slidably engaging the mandrel shaft adapter, the box mandrel assembly comprising:
- (i) a first bearing bore;
- (ii) a first retainer ring groove;
- (iii) a second bearing bore;
- (iv) a second retainer ring groove;
- (v) a conduit formed between the first and second bearing bores;
- (vi) a plurality of tightening holes connecting the box mandrel assembly to a first drill pipe connection;
- (vii) a first ball bearing assembly in the first bearing bore and a second ball bearing assembly in the second bearing bore; and
- (viii) a retainer ring for engaging the each retainer ring groove;

e. a box facing mandrel adapter connected to the male mandrel adapter, the box facing mandrel adapter comprising:
- (i) a box facing mandrel adapter shaft for engaging with the mandrel shaft adapter through the box mandrel assembly; and
- (ii) a face plate flange with bolt holes, the face plate flange extending from the box facing mandrel adapter shaft;

f. an outer face plate comprising:
- (i) a centrally formed face plate bore for mounted over the box mandrel assembly; and
- (ii) a plurality of face plate holes, the outer face plate for engaging the flange of the box refacing tube each face plate hole engaging a fastener; and g. an inner face plate comprising:
- (i) a centrally formed inner face plate bore for mounting over the box facing mandrel adapter; and
- (ii) a plurality of inner face plate holes, the inner face plate secured to the face plate flange with fasteners.

2. The assembly of claim 1, comprising an abrasive material mounted to the outer face plate for enabling refacing of a drill pipe connection shoulders simultaneously.

3. A double face pin mandrel assembly comprising:

a. a pin refacing tube comprising:
- (i) a first end and a second end;
- (ii) an outer side;
- (iii) a shaft bore and a counter bore formed between the first end and the second end;
- (iv) a flange extending from the outer side adjacent the first end;
- (v) a plurality of fastening holes formed in the flange;
- (vi) an undercut formed on the outer side and adjacent the flange;
- (vii) a plurality of male mandrel fastening holes penetrating the second end; and
- (viii) a plurality of tightening holes formed though the outer side;

b. a male mandrel adapter for engaging within the shaft bore of the pin refacing tube, the male mandrel adapter comprising:
- (i) a shaft with a tapped hole for securing to a grinder;
- (ii) a mandrel flange connected to the shaft;
- (iii) a mandrel shaft adapter attached to the shaft; and
- (iv) a plurality of male mandrel adapter fastening holes;

c. a pin mandrel assembly floating over the male mandrel adapter, comprising:
- (i) a first bearing bore;
- (ii) a first retainer ring groove;
- (iii) a second bearing bore;
- (iv) a second retainer ring groove;
- (v) a third retainer ring groove;
- (vi) a conduit formed between the first and second bearing bores;
- (vii) a plurality of tightening holes connecting the pin mandrel assembly to a second drill pipe connection;
- (viii) a first ball bearing assembly in the first bearing bore and a second ball bearing assembly in the second bearing bore; and
- (ix) a retainer ring for engaging each retainer ring groove;

d. a pin facing mandrel adapter connected to the male mandrel adapter, the pin facing mandrel adapter comprising:
- (i) a pin facing mandrel adapter shaft for engaging with the mandrel shaft adapter through the pin mandrel assembly; and
- (ii) a face plate flange with bolt holes, the face plate flange extending from the pin facing mandrel adapter shaft;

e. an outer face plate comprising:
- (i) a centrally formed face plate bore for mounting over the pin mandrel assembly; and (ii) a plurality of face plate holes, the outer face plate for engaging the flange of the pin refacing tube, each face plate hole engaging a fastener; and f. an inner face plate comprising:

(i) a centrally formed inner face plate bore for mounting over the pin facing mandrel adapter; and (ii) a plurality of inner face plate holes, the inner face plate secured to the face plate flange with fasteners.

4. The assembly of claim 3, comprising an abrasive material mounted to the outer face plate for enabling refacing of a drill pipe connection to simultaneously cut from the inner face plate to the outer face plate.

* * * * *